US012054935B2

(12) United States Patent
Li et al.

(10) Patent No.: US 12,054,935 B2
(45) Date of Patent: Aug. 6, 2024

(54) COLLAPSIBLE BUILDING FRAME STRUCTURE

(71) Applicant: A&C Future, Inc, Newport Beach, CA (US)

(72) Inventors: Sichen Li, Irvine, CA (US); Zhuangboyu Zhou, Santa Ana, CA (US); Jiuqi Wang, Tustin, CA (US); Keguan Zou, Irvine, CA (US); Jiayang Qin, Newport Beach, CA (US); Han Qin, Newport Beach, CA (US); Xunmin Jiang, Irvine, CA (US)

(73) Assignee: A&C Future Inc, Newport Beach, CA (US)

( * ) Notice: Subject to any disclaimer, the term of this patent is extended or adjusted under 35 U.S.C. 154(b) by 0 days.

(21) Appl. No.: 17/891,917

(22) Filed: Aug. 19, 2022

(65) Prior Publication Data

US 2024/0060288 A1 Feb. 22, 2024

(51) Int. Cl.
*E04B 1/343* (2006.01)

(52) U.S. Cl.
CPC ..... *E04B 1/34305* (2013.01)

(58) Field of Classification Search
CPC ..... E04B 1/34331; E04B 1/34305; E04B 1/34317; E04H 15/46
See application file for complete search history.

(56) References Cited

U.S. PATENT DOCUMENTS 2,723,673 A * 11/1955 Call ..... E04H 15/46 135/147
3,995,649 A * 12/1976 Robichaud ..... E04H 15/06 135/136
2006/0230704 A1* 10/2006 Lambreth ..... E04B 1/3442 52/745.02
2010/0018131 A1* 1/2010 Green ..... E04B 1/24 52/79.5
2017/0265646 A1* 9/2017 Rowe, Jr. ..... E04H 15/46

FOREIGN PATENT DOCUMENTS

EP 2535470 A1 * 12/2012 ..... E04B 1/24
FR 2130868 A5 * 3/1971 ..... E04H 15/46
WO WO-2021181374 A1 * 9/2021 ..... E04H 15/46

* cited by examiner

*Primary Examiner* — Christine T Cajilig
(74) *Attorney, Agent, or Firm* — Elizabeth Yang

(57) ABSTRACT

The present invention provides a collapsible building frame structure, which is a cuboid or a cube, comprising: 8 corner units, each corner unit has two horizontal rods and a vertical rod, the horizontal rods and the vertical rod are perpendicular to each other, and the vertical rods of every two vertically adjacent corner units are connected and fixed to each other; and a plurality of horizontal sleeve rods, which are hollow rod bodies, and the horizontal sleeve rods are arranged between any two horizontally adjacent corner units, and two ends of the horizontal sleeve rods are respectively for the horizontal rods of the two horizontally adjacent corner units to be inserted, and move within the horizontal sleeve rods to adjust the size of the collapsible building frame structure. Through those structure, the workers can quickly construct a frame structure for a building, which can significantly improve the construction efficiency.

4 Claims, 12 Drawing Sheets

COLLAPSIBLE BUILDING FRAME STRUCTURE

FIELD OF THE INVENTION

The present invention relates generally to a collapsible building frame structure, and more particularly, the present invention effectively improves the traditional building process by optimizing the construction process by providing a collapsible building frame to shorten the building time. The present invention further comprises two different structural designs that can make the user possible to choose different designs of collapsible frames according to the needs at the time of use.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Today the demand in the housing market is increasing due to the continuous increase in the world population. Traditional methods of building houses use load-bearing structures, which consume a lot of labor and materials, have a large amount of building materials to transport, take a long time to build, and often generate a lot of construction waste at the construction site due to the construction method, resulting in a poor construction environment.

The common building structures consist of reinforced concrete structure, steel beam structure, wood structure, and light steel structure. Traditional reinforced concrete structure takes a long time to build and have a poor building environment, while wood frame structures are less costly but can carry lower loads. Light steel structures have a more complex structure than other methods. Steel-beam framed structures show clear advantages in these building structures.

Traditional steel beam structures require the assistance of mechanical tools such as cranes to complete the movement and installation because of the high density of steel materials. Machinery that can move steel beams is generally large in size, takes a long time to transport or move, and is costly. When installing the frame, it takes time to position the steel because it does not have pre-set connections.

Many prefabricated structures of construction can be manufactured in factories and transported to the construction site for direct installation, which is convenient and fast. However, current prefabricated structures are mostly prefabricated concrete slabs and prefabricated walls, which take longer to transport than traditional reinforced concrete structures, and save less time when constructed at the construction site. Also, prefabricated structures are too simple, resulting in no great improvement in prefabricated methods of construction compared to traditional construction.

Thus, there is still a need for a new construction model or house construction method. The new construction method will change the existing construction mode if it can: use steel structure for the main body, simplify the frame installation process, avoid, or minimize the use of large machinery, increase the interaction between structures, and transport easily. The present invention is dedicated to meet the above needs by inventing a new steel frame to realize this future concept of construction method.

SUMMARY

In order to solve the problem above, the present invention redefines the way of constructing wires by prefabricating the wires on the beams and columns. Furthermore, the prefabricated wires have unique arrangements to allow the worker to connect the wires directly when installing the beams and columns to speed up the construction of the building.

It is therefore an object of the present invention to provide collapsible building frames that can be mass-produced in a factory by a manufacture.

It is another object of the present invention to provide a new way of processing building frames.

It is yet another object of the present invention to provide an improved traditional way of building houses, thereby increasing the efficiency of building houses.

To achieve the objects above, the present invention provides a collapsible building frame structure, which is a cuboid or a cube, comprising:

8 corner units, each corner unit has two horizontal rods and a vertical rod, the horizontal rods and the vertical rod are perpendicular to each other, and the vertical rods of every two vertically adjacent corner units are connected and fixed to each other; and a plurality of horizontal sleeve rods, which are hollow rod bodies, and the horizontal sleeve rods are arranged between any two horizontally adjacent corner units, and two ends of the horizontal sleeve rods are respectively for the horizontal rods of the two horizontally adjacent corner units to be inserted, and move within the horizontal sleeve rods to adjust the size of the collapsible building frame structure.

In another aspect, wherein one end of each horizontal rod is provided with a fixing member, and the fixing members are provided with a plurality of protruding structures, and surfaces adjacent to two ends of each horizontal sleeve rod are respectively provided with a plurality of holes correspondingly for the protruding structures to be inserted into the holes to detachably attach the horizontal rod in the horizontal sleeve.

In another aspect, wherein a plurality of chutes are provided in each of the horizontal sleeve rods, and a plurality of pulleys are provided on surface of each of the horizontal rods adjacent to the fixing member for the horizontal rod to slide within the horizontal sleeve rod.

In another aspect, wherein a plurality of springs is arranged in the fixing member, which is connected with the protruding structures, so that the protruding structures can expand and contract through elastic force.

Furthermore, the present invention further presents another embodiment for a collapsible building frame structure, which is a cuboid or a cube with a plurality of first sides and a plurality of second sides, any two of the first sides are parallel to each other, and any two of the second sides are parallel to each other, and the first sides and the second sides are perpendicular to each other, comprising:

8 corner units, each corner unit has two corner horizontal rods and a corner vertical sleeve rod, the corner horizontal rods and the corner vertical sleeve rod are perpendicular to each other, and the corner vertical sleeve rods of every two vertically adjacent corner units are connected through a vertical connecting rod;

a plurality of multi-connecting units, which are located on the first sides, each of the multi-connecting units has two horizontal sleeve rods, a horizontal rod and a vertical sleeve rod, the horizontal sleeve rods are located on a same straight line, and the horizontal sleeve rods, the horizontal rod, and the vertical sleeve rod are perpendicular to each other, and the vertical sleeve rods of every two vertically adjacent multi-connection units are also connected through the vertical connecting rod, and the horizontal sleeve rods are each connected to the adjacent corner horizontal rods through a horizontal connector, and the horizontal connectors are open at one end for the insertion of the corner horizontal rods, and the other end is a closed surface for insertion into the horizontal sleeve rods; and a plurality of T-shape units, which are located on the second sides and connecting lines between the horizontal rods of the multi-connecting units, each of the T-shape units having two auxiliary horizontal sleeve rods and an auxiliary vertical sleeve rod, and the auxiliary vertical sleeve rods of every two vertically adjacent T-shape units are also connected through the vertical connecting rod, and the auxiliary horizontal sleeve rods are also each connected to the adjacent horizontal rods or the corner horizontal rods through the horizontal connectors;

wherein, the corner vertical sleeve rods, the vertical sleeve rods and the auxiliary vertical sleeve rods are respectively moved on the vertical connecting rods to adjust the height of the collapsible building frame structure; linkages of the horizontal sleeve rods, the horizontal connectors and the corner horizontal rods can adjust the length of the collapsible building frame structure on the first sides; linkages of the auxiliary horizontal sleeve rods, the horizontal connectors, and the horizontal rods and linkages of the auxiliary horizontal sleeve rods, the horizontal connectors and the corner horizontal rods are used to adjust the length of the collapsible building frame structure on the second sides.

In another aspect, wherein one end of the corner horizontal rods, one end of the horizontal rods, both ends of the vertical connecting rods and closed ends of the horizontal connectors are each provided with a fixing member, and the fixing members are provided with a plurality of protruding structures, and adjacent to one end surface of the horizontal sleeve rods, one end surface of the vertical sleeve rods, one end surface of the auxiliary vertical sleeve rods, one end surface of the corner vertical sleeve rods, and one end surface of the auxiliary horizontal sleeve rods are respectively provided with a plurality of holes correspondingly for the protruding structures to be inserted into the holes.

In another aspect, wherein the horizontal sleeve rods, the vertical sleeve rods, the auxiliary vertical sleeve rods, the corner vertical sleeve rods and the auxiliary horizontal sleeve rods are provided with a plurality of chutes, and the corner horizontal rods, the horizontal rods, the vertical connecting rod, and the horizontal connectors are respectively provided with a plurality of pulleys on surface adjacent to the fixing member for the pulleys to slide on the chutes.

In another aspect, wherein a plurality of springs is arranged in the fixing member, which is connected with the protruding structures, so that the protruding structures can expand and contract through elastic force.

The present invention contains power cable system with prefabricated utilities, and beams-columns connections. The design optimizes the way of installation of connections between the wires on the beams and the columns during the construction of building. Once the beams and columns are built and connected, the wires are simply plug in by the ports and the connectors to complete the wire constructions.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
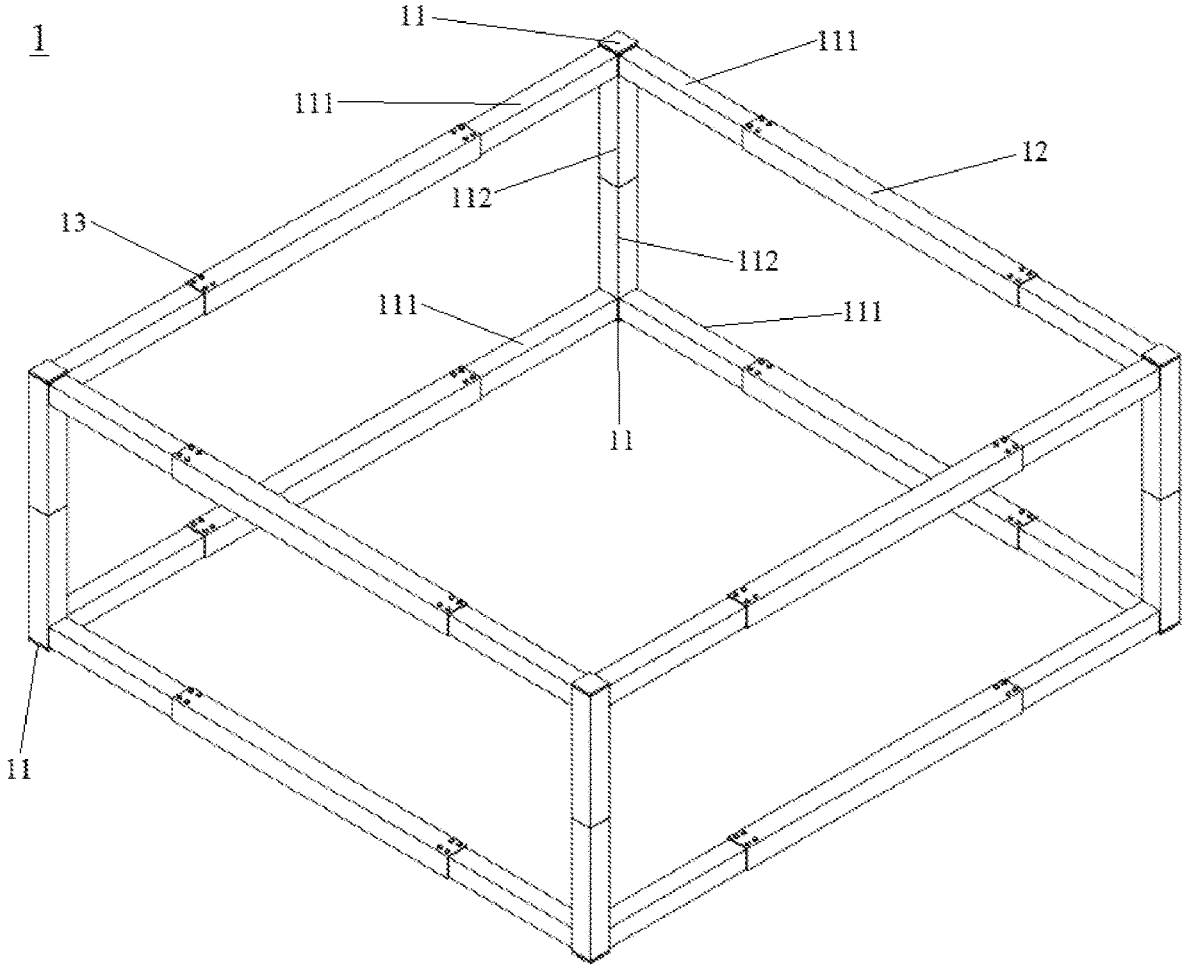
FIG. 1 illustrates the schematic view of a first embodiment of a collapsible building frame structure in the expended status.
Figure 2:
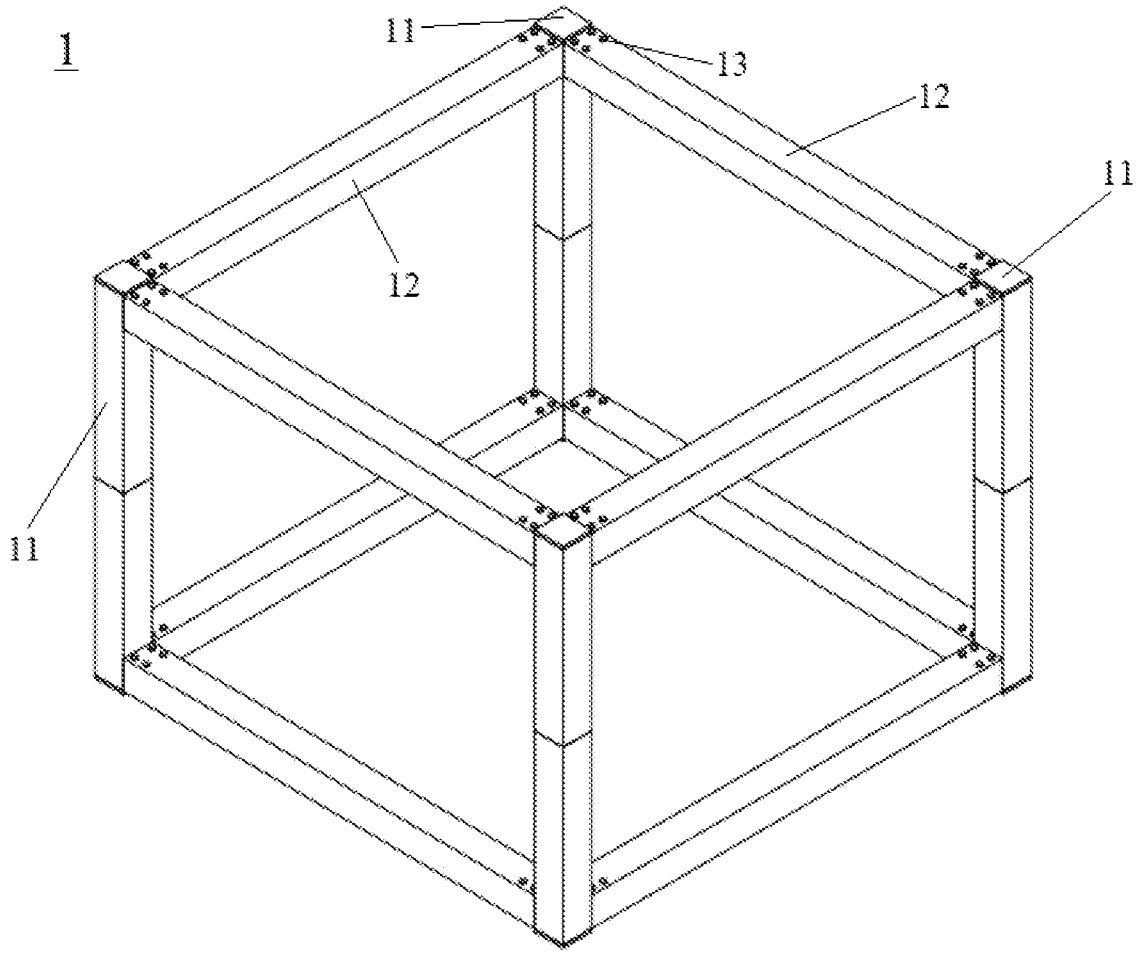
FIG. 2 illustrates the schematic views of the first embodiment of the collapsible building frame structure in the contracted status.
Figure 3:
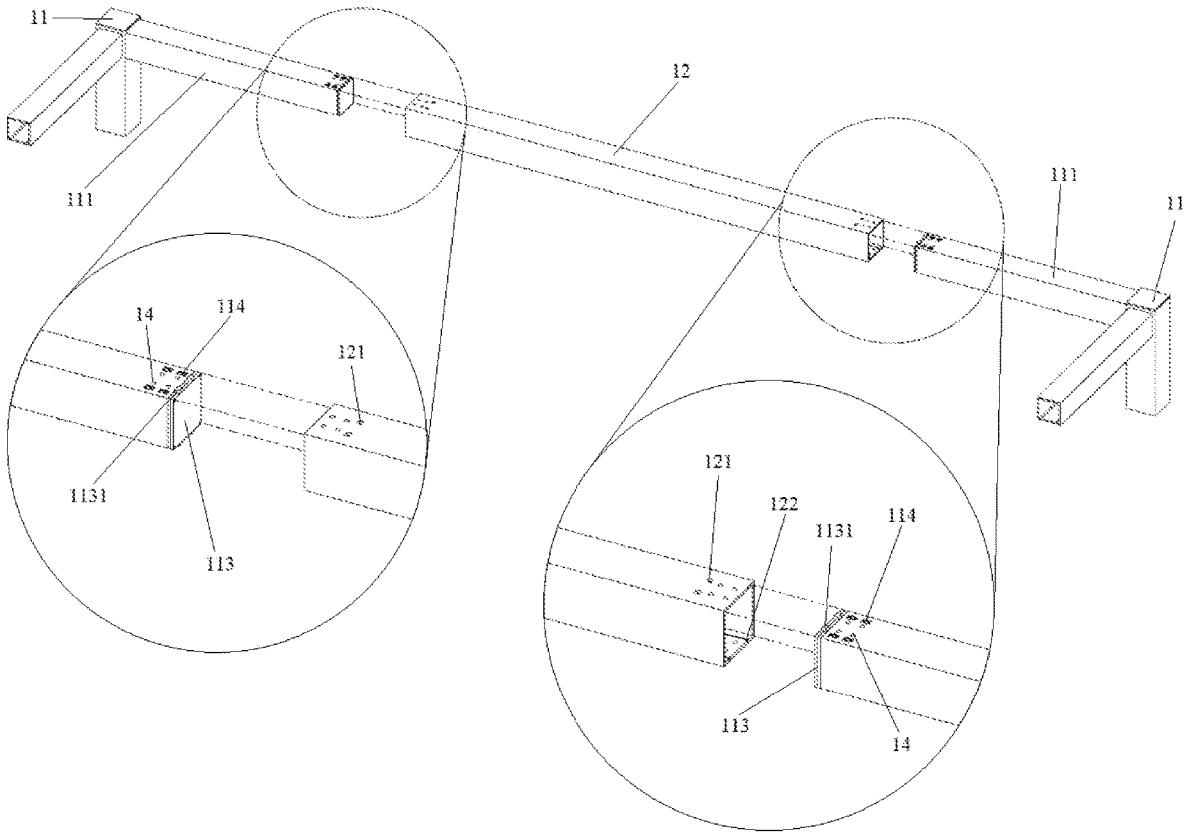
FIG. 3 illustrates the explosion view of the linkage of the horizontal sleeve rod, and the horizontal rods in the first embodiment.

Please refer to FIGS. 1-3, they illustrate the schematic views of collapsible building frame structure in the expended & contracted status and the detailed components that is needed to build the present invention. In the present invention, a collapsible building frame structure 1, which is a cuboid or a cube, has 8 corner units 11 and a plurality of horizontal sleeve rods 12. Each corner unit 11 has two horizontal rods 111 and a vertical rod 112, the horizontal rods 111 and the vertical rod 112 are perpendicular to each other, and the vertical rods 112 of every two vertically adjacent corner units 11 are connected and fixed to each other. The horizontal sleeve rods 12 are hollow rod bodies, and the horizontal sleeve rods 12 are arranged between any two horizontally adjacent corner units 11, and two ends of the horizontal sleeve rods 12 are respectively for the horizontal rods 111 of the two horizontally adjacent corner units 11 to be inserted, and move within the horizontal sleeve rods 12 to adjust the size of the collapsible building frame structure 1. Through the above structure, the collapsible building frame structure 1 can freely switch between the expanded status and the contracted status. In the contracted status, it can make it easier for workers to transport, and at the construction site, the workers only need to convert it from the contracted status to the expanded status to quickly build the framework of the building, which greatly reduces the time required for construction.

Figure 9:
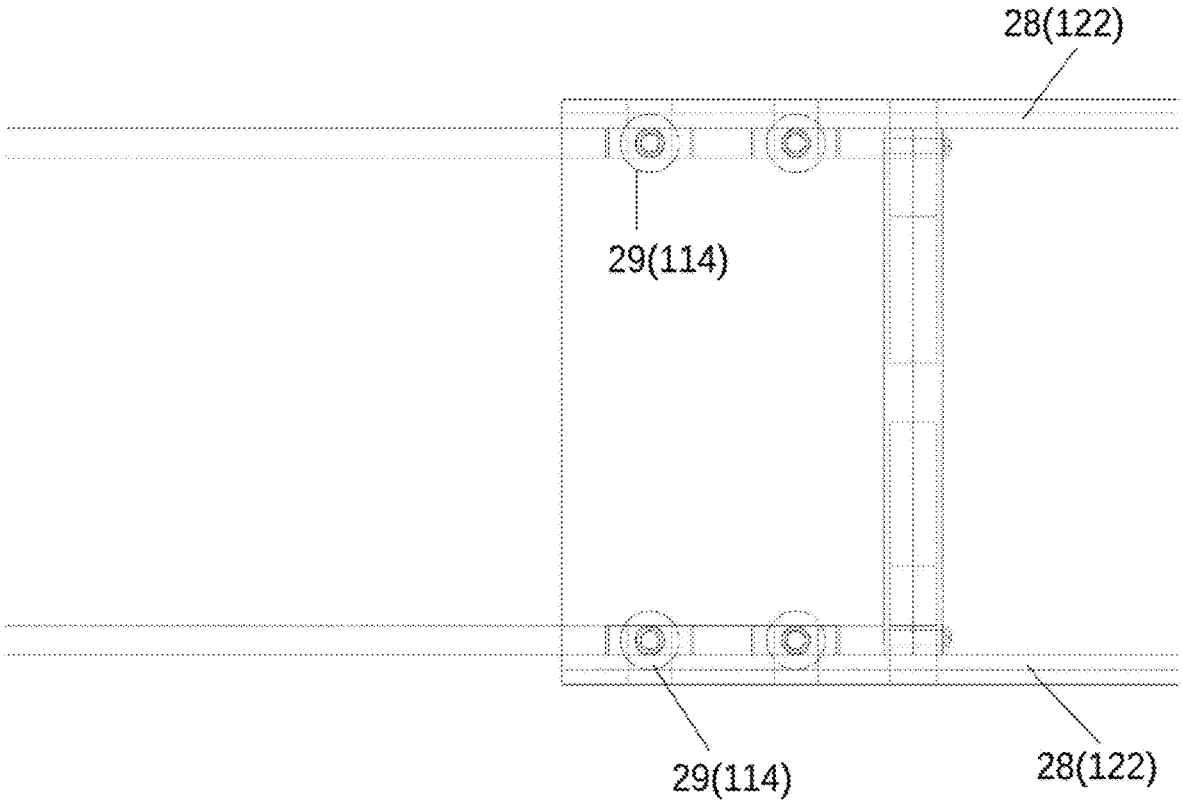
FIG. 9 illustrates the schematic view of the chutes and pulleys in the structure.

In this embodiment, one end of each horizontal rod 111 is provided with a fixing member 113, and the fixing members 113 are provided with a plurality of protruding structures 1131, and surfaces adjacent to two ends of each horizontal sleeve rod 12 are respectively provided with a plurality of holes 121 correspondingly for the protruding structures 1131 to be inserted into the holes 121 to detachably attach the horizontal rod 111 in the horizontal sleeve rod 12, like shown in FIG. 9, the pulleys 114 are rolling smoothly in the chutes 122. Such a structure allows the collapsible building frame structure 1 to expand and contract more efficiently, and there is no need to worry about the stability of the structure when it is in expanded status. In addition, a plurality of springs 1132 is arranged in the fixing member 113, which is connected with the protruding structures 1131, so that the protruding structures 1131 can expand and contract through elastic force. With the assistance of the elastic force, the structural rigidity of the collapsible building frame structure 1 will be stronger when it is in the expanded status, and the time for workers to switch between the expanded status and the contracted status can be reduced due to the setting of the springs 1132.

Figure 8:
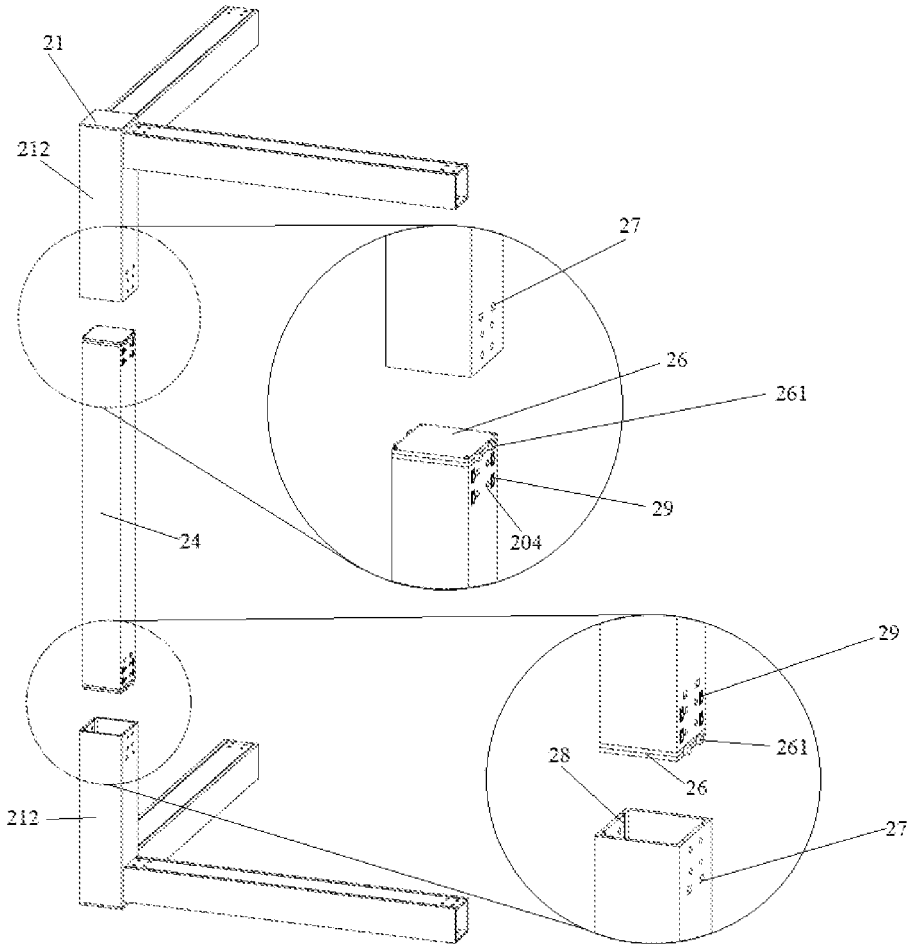
FIG. 8 illustrates the explosion view of the linkage of the corner vertical sleeve rods, and the vertical connecting rod in the second embodiment.
Figure 10A:
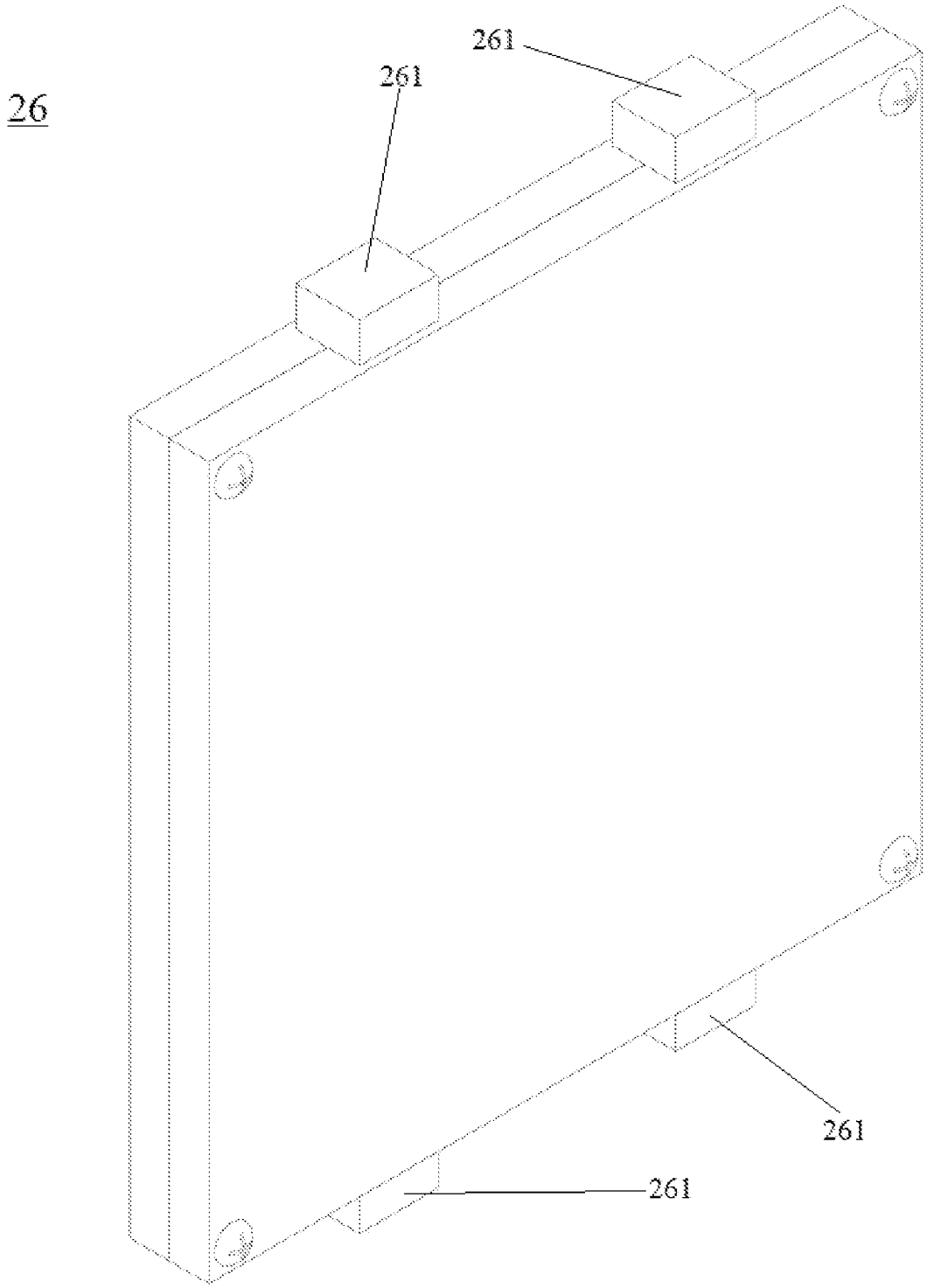
FIGS. 10A and 10B illustrate the schematic view and explosion view of the fixing member.
Figure 10B:
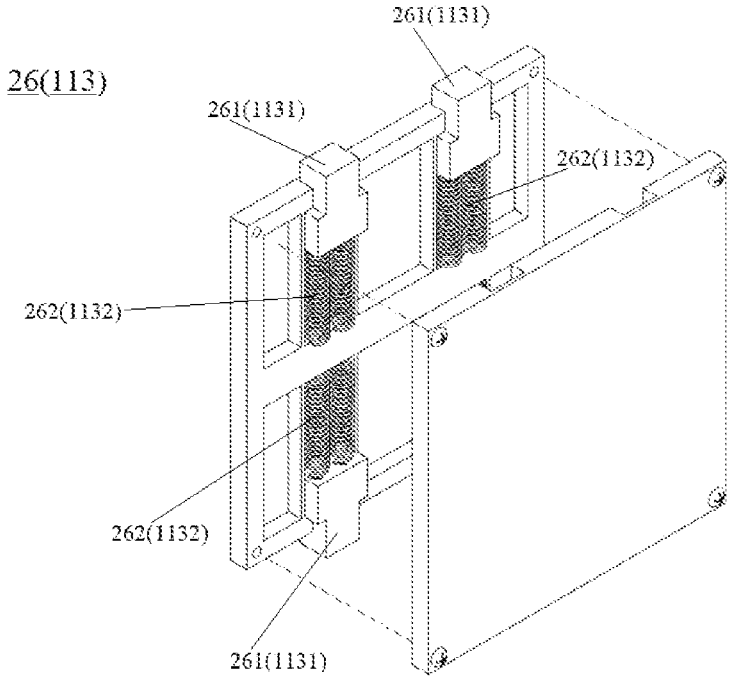

Furthermore, the present invention also provides a plurality of chutes 122 in each of the horizontal sleeve rods 12, and a plurality of pulleys 114 are provided on surface of each of the horizontal rods 111 adjacent to the fixing member 113 for the horizontal rod 111 to slide within the horizontal sleeve rod 12, like shown in FIGS. 10A & 10B. Such a chute 122 and pulley 114 structure make the collapsible building frame structure 1 smoother when contracting or extending, and less prone to failure and derailment. That is, the pulleys 114 roll in the chutes 122 during the unfolding of the frame 1 to help the parts of the frame 1 move against each other. When the frame 1 is fully expanded, a self-locking mechanism (the fixing member 113) on the hollow steel structure locks the steel beams in place, and the frame 1 is subsequently further strengthened by adding bolts 13, like shown in FIG. 8, to ensure the frame 1 cannot be expanded or loose while transporting. The bolts 13 can lock the horizontal rod 111 and horizontal sleeve rod 12 (which has holes 14 corresponding to the bolts) to ensure that the frame 1 is stable in both contracted status and expanded status.

Please refer to FIGS. 4-8, they illustrate the schematic views of collapsible building frame structure in the expended & contracted status and the detailed components that is needed to build the present invention. In this embodiment, the present invention provides another collapsible building frame structure 2 which is a cuboid or a cube with a plurality of first sides 201 and a plurality of second sides 202, any two of the first sides 201 are parallel to each other, and any two of the second sides 202 are parallel to each other, and the first sides 201 and the second sides 202 are perpendicular to each other. The collapsible building frame structure 1 has 8 corner units 21, a plurality of multi-connecting units 22, and a plurality of T-shape units 23. Each corner unit 21 has two corner horizontal rods 211 and a corner vertical sleeve rod 212, the corner horizontal rods 211 and the corner vertical sleeve rod 212 are perpendicular to each other, and the corner vertical sleeve rods 212 of every two vertically adjacent corner units 21 are connected through a vertical connecting rod 24. The multi-connecting units 22 are located on the first sides 201, each of the multi-connecting units 22 has two horizontal sleeve rods 221, a horizontal rod 222 and a vertical sleeve rod 223, the horizontal sleeve rods 221 are located on a same straight line, and the horizontal sleeve rods 221, the horizontal rod 222, and the vertical sleeve rod 223 are perpendicular to each other, and the vertical sleeve rods 223 of every two vertically adjacent multi-connection units 22 are also connected through the vertical connecting rod 24, and the horizontal sleeve rods 221 are each connected to the adjacent corner horizontal rods 211 through a horizontal connector 25, and the horizontal connectors 25 are open at one end for the insertion of the corner horizontal rods 211, and the other end is a closed surface for insertion into the horizontal sleeve rods 221. The T-shape units 23 are located on the second sides 202 and connecting lines between the horizontal rods 222 of the multi-connecting units 22, each of the T-shape units 23 having two auxiliary horizontal sleeve rods 231 and an auxiliary vertical sleeve rod 232, and the auxiliary vertical sleeve rods 232 of every two vertically adjacent T-shape units 23 are also connected through the vertical connecting rod 24, and the auxiliary horizontal sleeve rods 231 are also each connected to the adjacent horizontal rods 222 or the corner horizontal rods 211 through the horizontal connectors 25.

In this embodiment, the collapsible building frame structure 1 utilizes the following ways to adjust its expanded status and contracted status:

- The corner vertical sleeve rods 212, the vertical sleeve rods 223 and the auxiliary vertical sleeve rods 232 are respectively moved on the vertical connecting rods 24 to adjust the height of the collapsible building frame structure 1.
- Linkages of the horizontal sleeve rods 221, the horizontal connectors 25 and the corner horizontal rods 211 can adjust the length of the collapsible building frame structure 1 on the first sides.

Linkages of the auxiliary horizontal sleeve rods 231, the horizontal connectors 25, and the horizontal rods 222 and linkages of the auxiliary horizontal sleeve rods 231, the horizontal connectors 25 and the corner horizontal rods 211 are used to adjust the length of the collapsible building frame structure 1 on the second sides.

Figure 4:
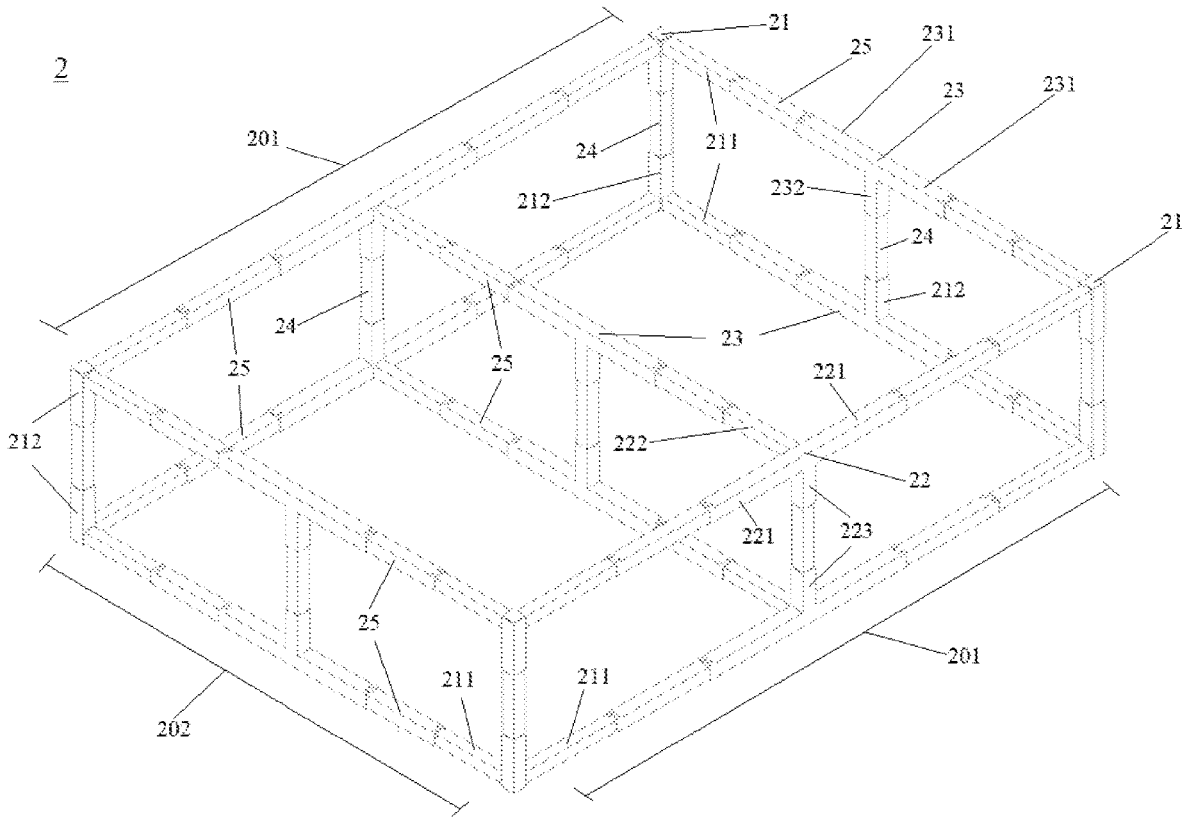
FIG. 4 illustrates the schematic view of a second embodiment of a collapsible building frame structure in the expended status.
Figure 5:
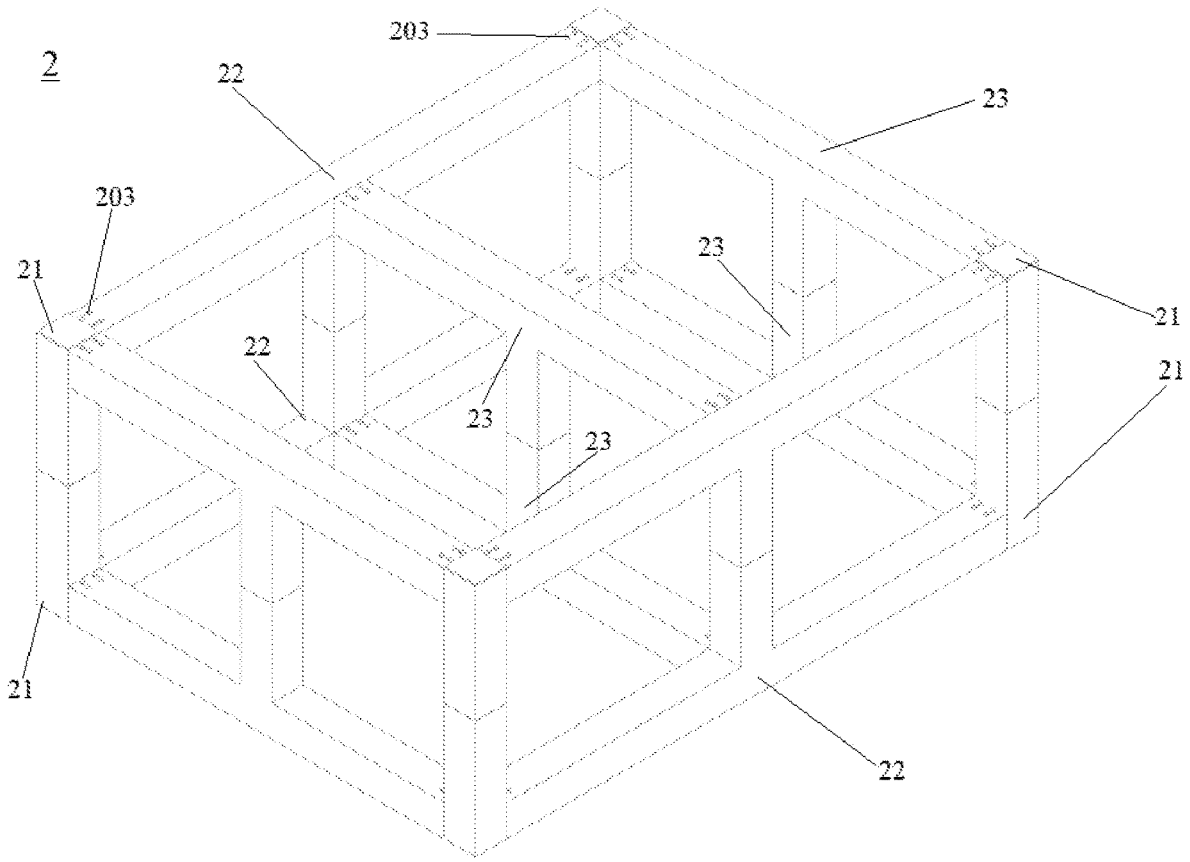
FIG. 5 illustrates the schematic views of the second embodiment of the collapsible building frame structure in the contracted status.
Figure 6:
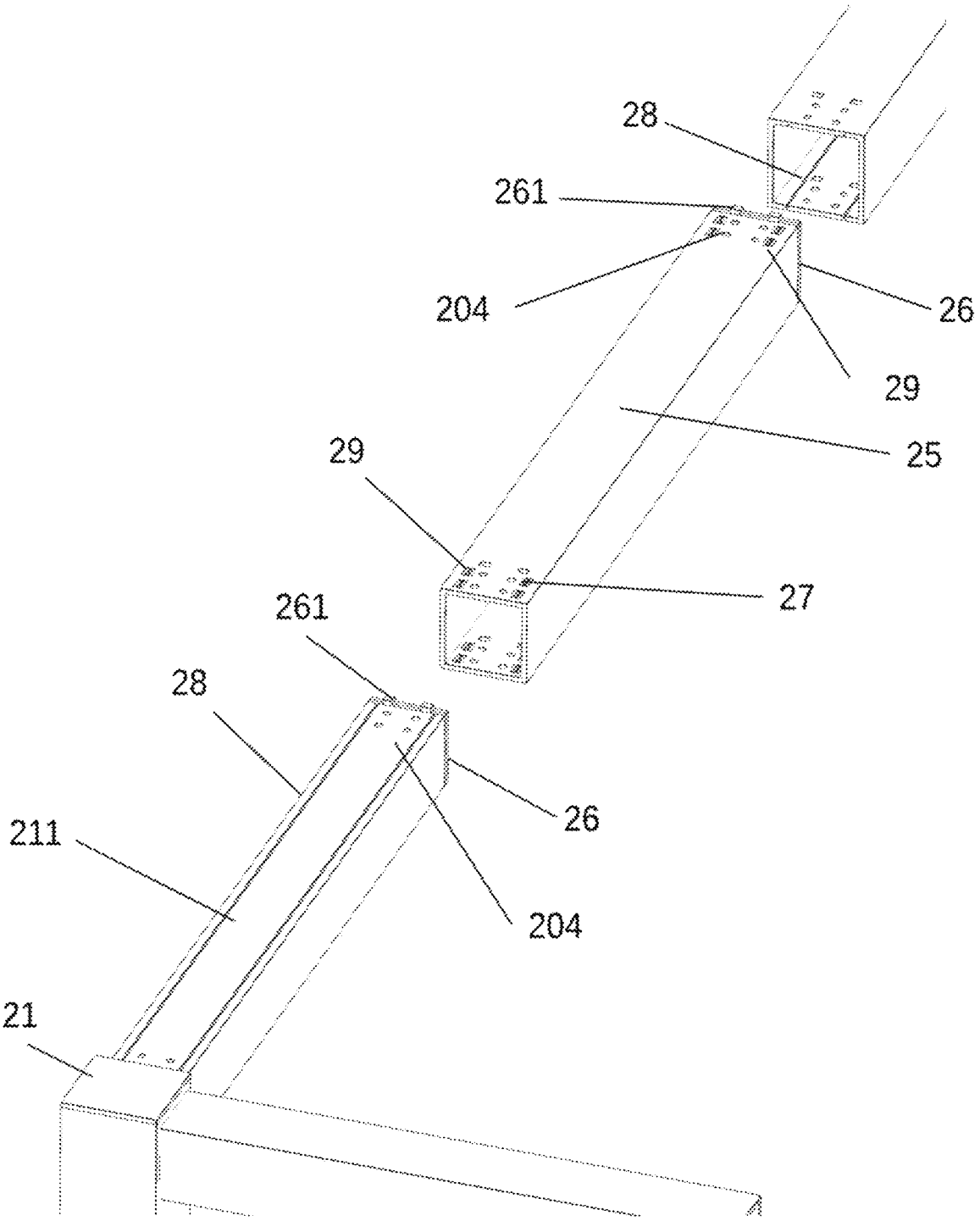
FIG. 6 illustrates the explosion view of the linkage of the horizontal sleeve rod, the horizontal connector and the corner horizontal rod in the second embodiment.
Figure 7:
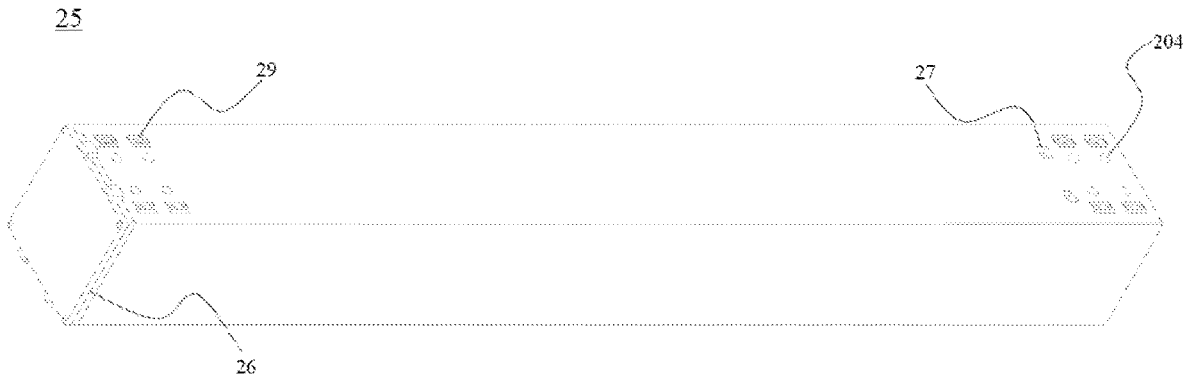
FIG. 7 illustrates the schematic view of the horizontal connector.

In addition, like shown in FIGS. 4-6, one end of the corner horizontal rods 211, one end of the horizontal rods 222, both ends of the vertical connecting rods 24 and closed ends of the horizontal connectors 25 are each provided with a fixing member 26, and the fixing members 26 are provided with a plurality of protruding structures 261, and adjacent to one end surface of the horizontal sleeve rods 221, one end surface of the vertical sleeve rods 223, one end surface of the auxiliary vertical sleeve rods 232, one end surface of the corner vertical sleeve rods 212, and one end surface of the auxiliary horizontal sleeve rods 231 are respectively provided with a plurality of holes 27 correspondingly for the protruding structures 261 to be inserted into the holes 27. Since the expansion and contraction in the horizontal direction are carried out in the same way, and the expansion and contraction in the vertical direction are also carried out in the same way, the present invention only shows part of the structure in the horizontal direction and part of the structure in the vertical direction, so that all the expansion and contraction modes of the present invention can be clearly represented.

In addition, such a structure can make the expansion and contraction of the collapsible building frame structure 2 more efficient, and it is not necessary to worry about the stability of the structure 2 when it is in the expanded status. And see also FIGS. 10A & 10B, a plurality of springs 262 is arranged in the fixing member 26, which is connected with the protruding structures 261, so that the protruding structures 261 can expand and contract through elastic force. With the assistance of the elastic force, the structural rigidity of the collapsible building frame structure 2 will be stronger when it is in the expanded status, and the time for workers to switch between the expanded status and the contracted status can be reduced due to the setting of the springs 262.

Furthermore, like shown in FIG. 9, in this embodiment, the horizontal sleeve rods 221, the vertical sleeve rods 223, the auxiliary vertical sleeve rods 232, the corner vertical sleeve rods 212, and the auxiliary horizontal sleeve rods 231 are provided with a plurality of chutes 28, and the corner horizontal rods 211, the horizontal rods 222, the vertical connecting rod 24, and the horizontal connectors 25 are respectively provided with a plurality of pulleys 29 on surface adjacent to the fixing member 26 for the pulleys 29 to slide on the chutes 28. Such a chute 28 and pulley 29 structure makes the collapsible building frame structure 1 smoother when contracting or extending, and less prone to failure and derailment.

Figure 11:
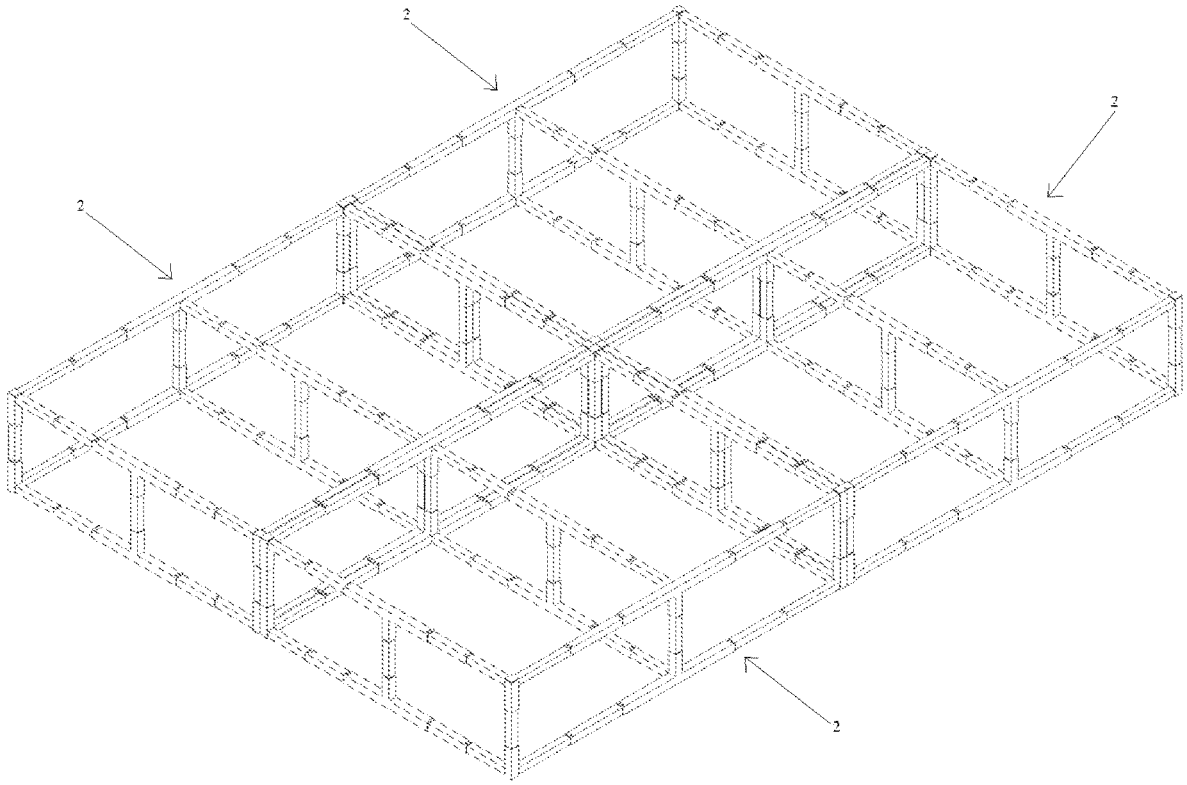
FIG. 11 illustrates the schematic view of collapsible building frame structure combined together.

In other words, the collapsible frame structure 1 has five sets of collapsible beams on upper portion, five sets of collapsible beams on lower portion, and nine sets of collapsible columns. One set of collapsible beams includes three multi-axial chute steel connectors connected by two sections of hollow steel structures with built-in chute 28 and pulleys 29. One set of collapsible columns consists of two multi-axial chute steel connectors connected by a section of hollow steel structure with built-in chute 28 and pulleys 29. The pulleys 29 roll in the chutes 28 during the unfolding of the frame 2 to help the parts of the frame 2 move against each other. When the frame 2 is fully expanded, a self-locking mechanism (the fixing member 26) on the hollow steel structure locks the steel beams and columns in place, and the frame 2 is subsequently further strengthened by adding bolts 203, like shown in FIG. 2, to ensure the frame 2 cannot be expanded or loose while transporting. When the frame 2 is in the expanded status, the bolts 203 can also be used to further strengthen the structural rigidity of the frame 2. That is, the bolts 203 can lock the all the rods and all the sleeve rods (which have holes 204 corresponding to the bolts 203) to ensure that the frame 2 is stable in both contracted status and expanded status. Furthermore, the frame 2 can be used alone or together with several frames 2 to expand the floor area, like shown in FIG. 11.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A collapsible building frame structure, which is a cuboid or a cube, comprising:

8 corner units, each corner unit has two horizontal rods and a vertical rod, the horizontal rods and the vertical rod are perpendicular to each other, and the vertical rods of every two vertically adjacent corner units are connected and fixed to each other; and a plurality of horizontal sleeve rods, which is hollow rod bodies, and the horizontal sleeve rods are arranged between any two horizontally adjacent corner units, and two ends of the horizontal sleeve rods are respectively for the horizontal rods of the two horizontally adjacent corner units to be inserted, and move within the horizontal sleeve rods to adjust the size of the collapsible building frame structure, wherein one end of each horizontal rod is provided with a fixing member, and the fixing members are provided with a plurality of protruding structures, and surfaces adjacent to two ends of each horizontal sleeve rod are respectively provided with a plurality of holes correspondingly for the protruding structures to be inserted into the holes to detachably attach the horizontal rod in the horizontal sleeve, and a plurality of chutes is provided in each of the horizontal sleeve rods, and a plurality of pulleys is provided on surface of each of the horizontal rods adjacent to the fixing member for the horizontal rod to slide within the horizontal sleeve rod.

2. The collapsible building frame structure of claim 1, wherein a plurality of springs is arranged in the fixing member, which is connected with the protruding structures, so that the protruding structures can expand and contract through elastic force.

3. A collapsible building frame structure, which is a cuboid or a cube with a plurality of first sides and a plurality of second sides, any two of the first sides are parallel to each other, and any two of the second sides are parallel to each other, and the first sides and the second sides are perpendicular to each other, comprising:

8 corner units, each corner unit has two corner horizontal rods and a corner vertical sleeve rod, the corner horizontal rods and the corner vertical sleeve rod are perpendicular to each other, and the corner vertical sleeve rods of every two vertically adjacent corner units are connected through a vertical connecting rod;

a plurality of multi-connecting units, which is located on the first sides, each of the multi-connecting units has two horizontal sleeve rods, a horizontal rod and a vertical sleeve rod, the horizontal sleeve rods are located on a same straight line, and the horizontal sleeve rods, the horizontal rod, and the vertical sleeve rod are perpendicular to each other, and the vertical sleeve rods of every two vertically adjacent multi-connection units are also connected through the vertical connecting rod, and the horizontal sleeve rods are each connected to the adjacent corner horizontal rods through a horizontal connector, and the horizontal connectors are open at one end for the insertion of the corner horizontal rods, and the other end is a closed surface for insertion into the horizontal sleeve rods; and a plurality of T-shape units, which is located on the second sides and connecting lines between the horizontal rods of the multi-connecting units, each of the T-shape units having two auxiliary horizontal sleeve rods and an auxiliary vertical sleeve rod, and the auxiliary vertical sleeve rods of every two vertically adjacent T-shape units are also connected through the vertical connecting rod, and the auxiliary horizontal sleeve rods are also each connected to the adjacent horizontal rods or the corner horizontal rods through the horizontal connectors;

wherein, the corner vertical sleeve rods, the vertical sleeve rods and the auxiliary vertical sleeve rods are respectively moved on the vertical connecting rods to adjust the height of the collapsible building frame structure; linkages of the horizontal sleeve rods, the horizontal connectors and the corner horizontal rods can adjust the length of the collapsible building frame structure on the first sides; linkages of the auxiliary horizontal sleeve rods, the horizontal connectors, and the horizontal rods and linkages of the auxiliary horizontal sleeve rods, the horizontal connectors and the corner horizontal rods are used to adjust the length of the collapsible building frame structure on the second sides, one end of the corner horizontal rods, one end of the horizontal rods, both ends of the vertical connecting rods and closed ends of the horizontal connectors are each provided with a fixing member, and the fixing members are provided with a plurality of protruding structures, and adjacent to one end surface of the horizontal sleeve rods, one end surface of the vertical sleeve rods, one end surface of the auxiliary vertical sleeve rods, one end surface of the corner vertical sleeve rods, and one end surface of the auxiliary horizontal sleeve rods are respectively provided with a plurality of holes correspondingly for the protruding structures to be inserted into the holes, and the horizontal sleeve rods, the vertical sleeve rods, the auxiliary vertical sleeve rods, the corner vertical sleeve rods and the auxiliary horizontal sleeve rods are provided with a plurality of chutes, and the corner horizontal rods, the horizontal rods, the vertical connecting rod, and the horizontal connectors are respectively provided with a plurality of pulleys on surface adjacent to the fixing member for the pulleys to slide on the chutes.

4. The collapsible building frame structure of claim 3, wherein a plurality of springs is arranged in the fixing member, which is connected with the protruding structures, so that the protruding structures can expand and contract through elastic force.

* * * * *